United States Patent [19]

Scheibengraber

[11] 4,290,341

[45] Sep. 22, 1981

[54] ROTARY ENGINE

[76] Inventor: Karl J. Scheibengraber, 6025 W. Spencer Pl., Milwaukee, Wis. 53218

[21] Appl. No.: 53,873

[22] Filed: Jul. 2, 1979

[51] Int. Cl.[3] ..... F01C 9/00

[52] U.S. Cl. ..... 91/339; 123/18 R

[58] Field of Search ..... 91/339; 123/18 R, 245; 417/481; 418/135

[56] References Cited

U.S. PATENT DOCUMENTS

| | | | |
|---|---|---|---|
| 625,689 | 5/1899 | Kingsland | 418/135 |
| 925,203 | 6/1909 | Leiman et al. | 417/481 |
| 1,236,009 | 8/1917 | Saunders | 123/18 R X |
| 1,283,375 | 10/1918 | Vik | 123/18 R |
| 3,707,073 | 12/1972 | Bernstein | 123/18 R X |
| 3,948,226 | 4/1976 | Green et al. | 123/18 R |

FOREIGN PATENT DOCUMENTS

| | | | |
|---|---|---|---|
| 1367633 | 6/1964 | France | 123/18 R |

*Primary Examiner*—Michael Koczo

*Attorney, Agent, or Firm*—Wheeler, Morsell, House & Fuller

[57] ABSTRACT

A rotary engine employs one or more flap-type pistons which swing about a fixed pivot. Power is transmitted from the pistons to the output shaft by pins connected to the piston which ride in figure eight grooves in a pair of spaced discs connected to the output shaft. The discs are spring-loaded toward each other to provide side seals along the sides of the pistons. Ports in the discs register with a working chamber in the appropriate sequence for the intake and exhaust strokes. Hence conventional valving is not required.

5 Claims, 7 Drawing Figures

3
3

Fig. 4
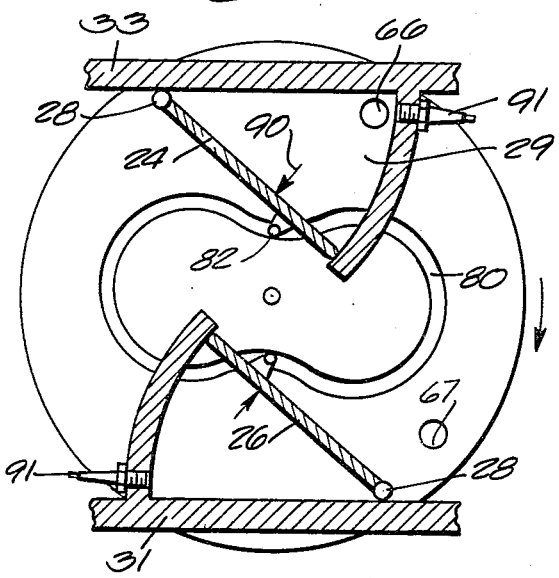
Fig. 5
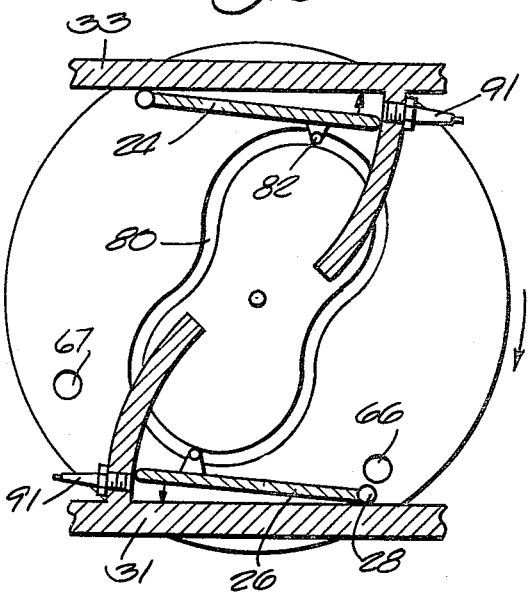
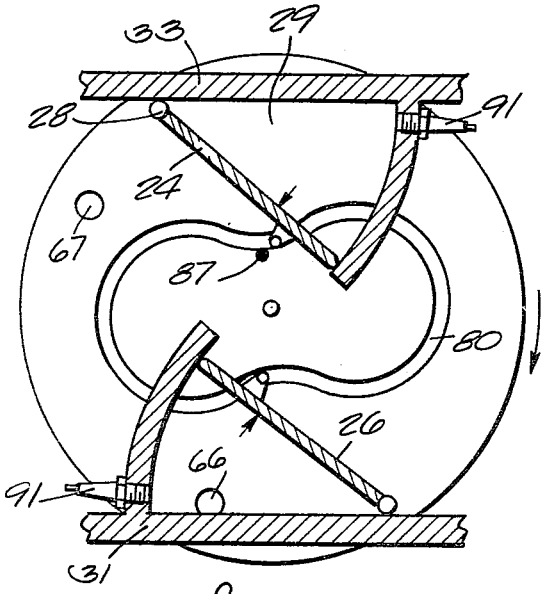
Fig. 6
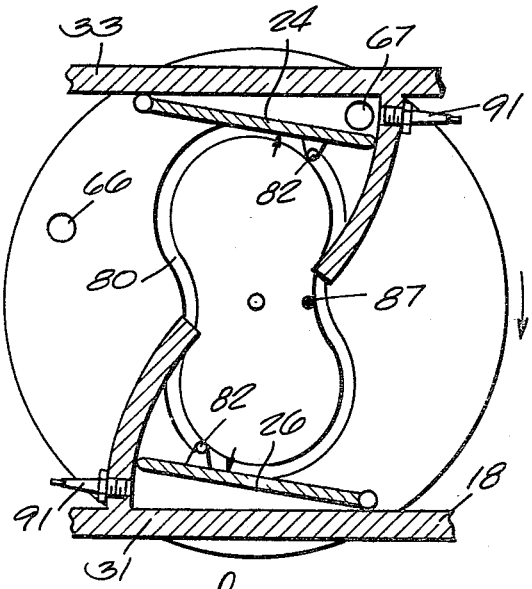
Fig. 7

ROTARY ENGINE

BACKGROUND OF THE INVENTION

The disadvantages of conventional piston type engines are well known and include the vibration produced by the pistons and crank shaft in converting rectilinear motion of the piston to rotary motion of the crank shaft. Various types of rotary engines have been developed to minimize these problems and improve the overall efficiency of internal combustion engines. The present invention relates to engines employing a pivoted plate or flap which serves as the piston. U.S. Pat. No. 3,707,073 is illustrative of engines of this category. The engine shown in that patent, however, uses conventional valving to control the intake and exhaust events and hence is not an advance with respect to intake and exhaust valve construction.

SUMMARY OF THE INVENTION

The engine of the present invention employs a pair of spaced discs which are connected to the output shaft and form the side walls of the working chamber. The discs include exhaust and intake ports which move into registry with the working chambers during the exhaust and intake functions, thus eliminating the need for conventional type valves operated by a mechanical system. In addition, the discs also provide the driving connection between the pistons and the output shaft. In this regard, cams or drive pins on the pistons are engaged in figure eight shaped cam tracks on the inside faces of the discs. Power is transmitted to the discs by contact of the drive pins with the surfaces of the cam track. The discs also serve as flywheels and can be provided with cooling fins if required.

The discs are spring-biased toward each other and maintained in contact with the sides of the pistons by axial locking devices. Thus the side seal of the discs with the pistons is maintained by the springs. Wankel type sealing technology can be employed for the piston end seal.

Further objects, advantages and features of the invention will become apparent from the disclosure.

DESCRIPTION OF THE DRAWINGS

FIGS. 4, 5, 6 and 7 are diagrammatic views showing the various operational cycles of the engine illustrated in FIGS. 1 and 2.

DESCRIPTION OF THE PREFERRED EMBODIMENT

Figure 1:
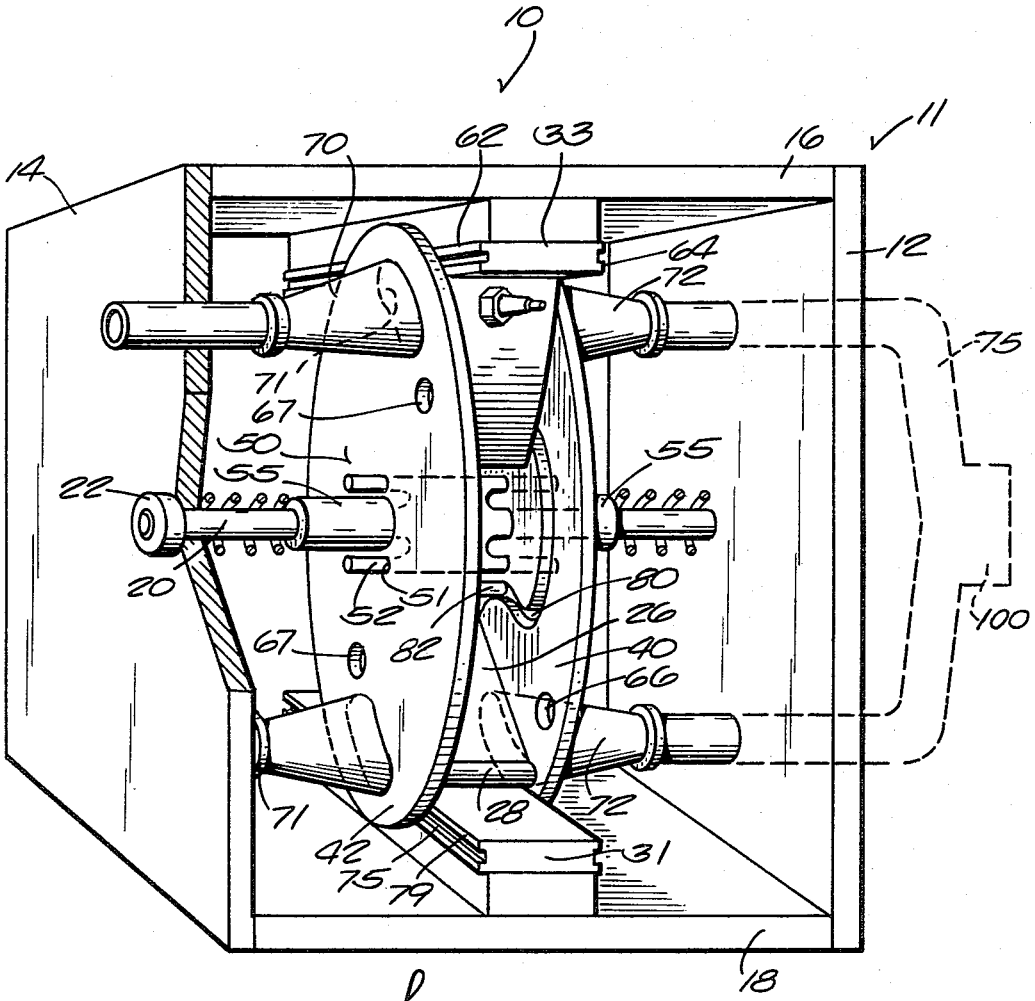
FIG. 1 is a diagrammatic perspective view with parts broken away of an engine in accordance with the invention.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The engine 10 includes a support frame 11 having opposed parallel side plates 12 and 14 interconnected by end walls 16 and 18. An output shaft 20 is rotatably supported in the side frames 12 and 14 by bearings 22.

The support frame can be mounted on a vehicle chassis (not shown). The output shaft 20 is driven by one or more pistons which are drivingly connected to the output shaft by a cam or drive pin fixed to the piston and a cam track on discs connected to the output shaft as subsequently described in detail.

Figure 2:
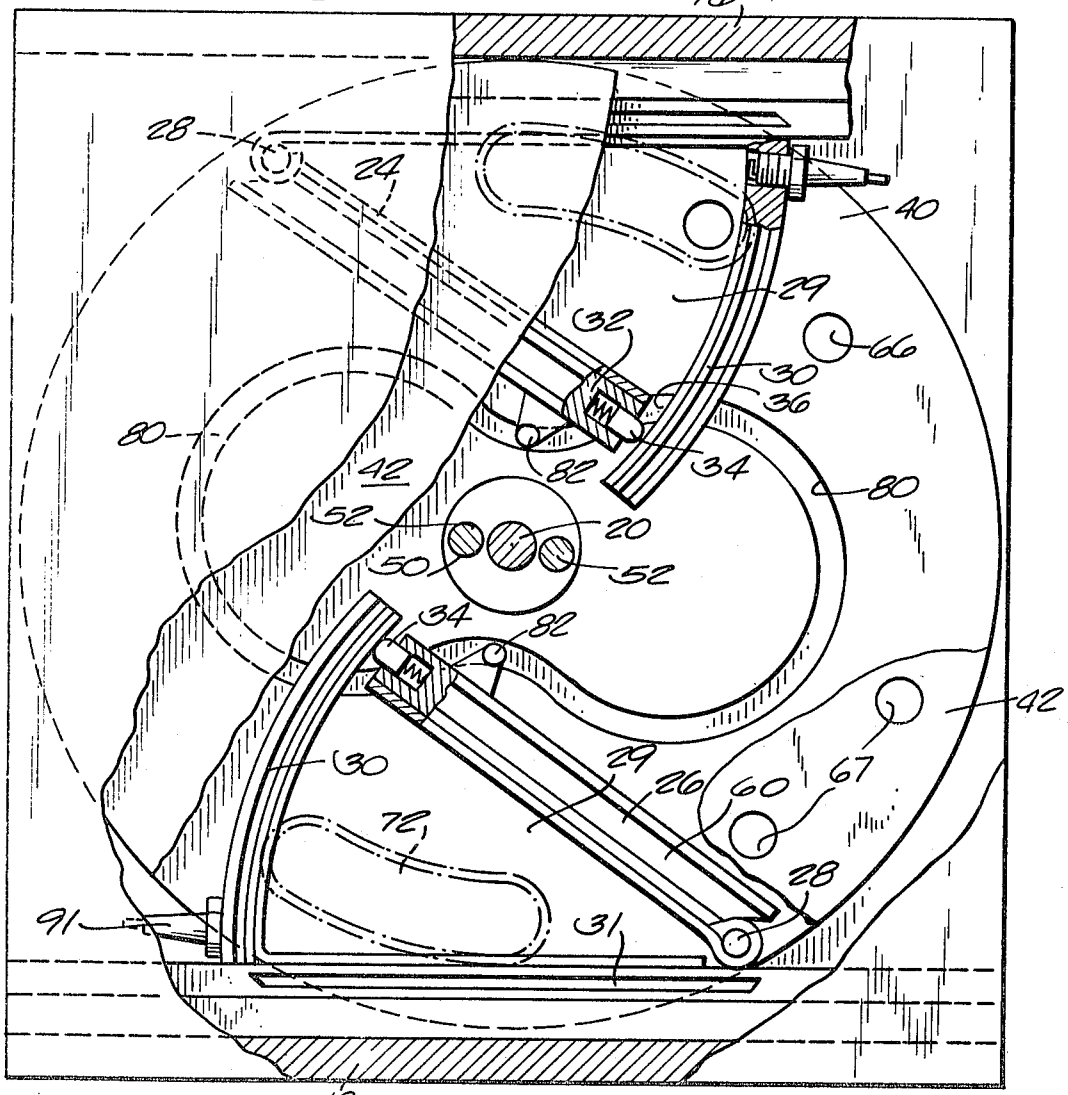
FIG. 2 is an enlarged side view of the engine shown in FIG. 1 with parts broken away.

More specifically, the engine illustrated in FIGS. 1 through 7 employs two pistons 24 and 26, best shown in FIG. 2, which are in the form of plates or flaps. Each piston 24, 26 is pivotally connected or hinged to the support frame 11 by pins 28. The pistons alternately perform four strokes or events, as is conventionally understood in the art, namely intake, compression, combustion and exhaust. The position of the pistons during these events is hereinafter described.

The working chambers 29 in which the pistons 24, 26 operate are generally wedge-shaped and defined in part by arcuate end walls 30 which are concentric with the pivot pins 28 of the pistons 24, 26. The pistons are provided with some form of end seal to seal the end of the swinging pistons 24, 26 to the end walls 30. As disclosed (FIG. 2), the end seal includes a U-shaped channel 32 at the end of the piston plate with a spring-loaded arcuate sealing member 34 which engages the surface 36 of the arcuate plate or end wall 30. Other suitable sealing arrangements could be employed.

The working chambers are also defined in part by the plates 31, 33 supported on end walls 16 and 18, as illustrated in FIGS. 4 through 7. The sides of the working chambers 29 are formed by a pair of opposed parallel plates or discs 40 and 42 which are slideably supported on the output shaft and biased toward the opposite edges of the pistons by an arrangement which includes a yoke 50 with guide rods 52 which extend through apertures 51 in the discs 40 and 42. The discs 40 and 42 are biased inwardly by spring-loaded one-way axial adjustment locks 55 which urge the plates toward the side edges of the pistons but which prevent the plates from separating from the pistons. The one-way axial adjustment lock can have pivoted eccentrics or cams which enable sliding of the plates in one direction but lock on shaft 20 to prevent outward movement or separation during combustion. The plates 31, 33 also engage the discs and have channels 60 with legs 62 and 64 which bear against the plates 31, 33 and wear into a sealing fit with the discs 40, 42 during the break-in period. Other suitable sealing arrangements can be employed.

A seal construction is provided between the pistons' edges and the discs 40, 42. As disclosed, the edges of the pistons are channelized with legs 69 (FIG. 3) contacting the inner surface of the discs 40, 42.

The intake and exhaust events or sequences are controlled by ports in the discs 40 and 42. The disc 40 is provided with a pair of closely spaced intake ports 66, and disc 42 is provided with exhaust ports 67. The exhaust ports cooperate with exhaust manifolds 70 (FIG. 1) which have funnel-shaped spring-loaded heads 71 which make a sealing connection with the face of the disc 42. The two exhaust heads 71 (one for each working chamber) can be connected to a common manifold (not shown).

Each working chamber is also provided with an intake head 72 which is connected to a manifold 75. The intake heads carry seals 73 which are spring-loaded against the disc 40 to maintain a seal therewith.

Power is transmitted from the moving pistons during the combustion or power stroke to the output shaft by cooperating means on the piston and the discs 40, 42. As disclosed, the cooperating means comprises (FIG. 3) grooves or cam tracks 80 on inside faces of the discs 40, 42 and driving cams or drive pins 82 fixed to the pistons. The pins 82 for each piston have end portions located in the cam tracks of both discs 40, 42. The cam tracks 80 have a figure eight configuration and are milled or otherwise formed in the steel discs 40, 42. The figure eight configuration positions the pistons at the appropriate positions in the working chambers for each of the events.

The details of the accessory systems required for the engine, such as fuel, carburetion, ignition, exhaust, lubrication and cooling are not described in detail because conventional equipment and know-how, which forms no part of the invention herein, can be employed. Conventional spark plugs 91 can be used.

The operation of the engine is diagrammatically illustrated in FIGS. 4, 5, 6 and 7 which disclose the positions of the two pistons during various of the strokes. FIG. 4 illustrates the intake stroke for piston 24, with the intake port 66 aligned with the combustion chamber so that the fuel-air charge is emitted into the combustion chamber. During the intake stroke the piston is moving in the direction of the arrow 90 to cause a partial vacuum to assist in inducing flow of the fuel-air mixture into the working chamber. In FIG. 4, the piston 26 is just completing its power stroke.

In FIG. 5, piston 24 is completing the compression stroke just prior to ignition, and piston 26 commencing the intake stroke as soon as the port 66 arrives at the working chamber. In FIG. 6, the piston 24 is completing the power stroke. After the pin 82 reaches point 87 in the cam track, the piston 24 commences the exhaust stroke. In FIG. 7, the point 87 has advanced past pin 82 and the piston 24 is completing the exhaust stroke. The exhaust port 67 is open to the working chamber of piston 24 (as shown in FIG. 7), with piston 24 squeezing the combustion products from the working chamber.

Figure 3:
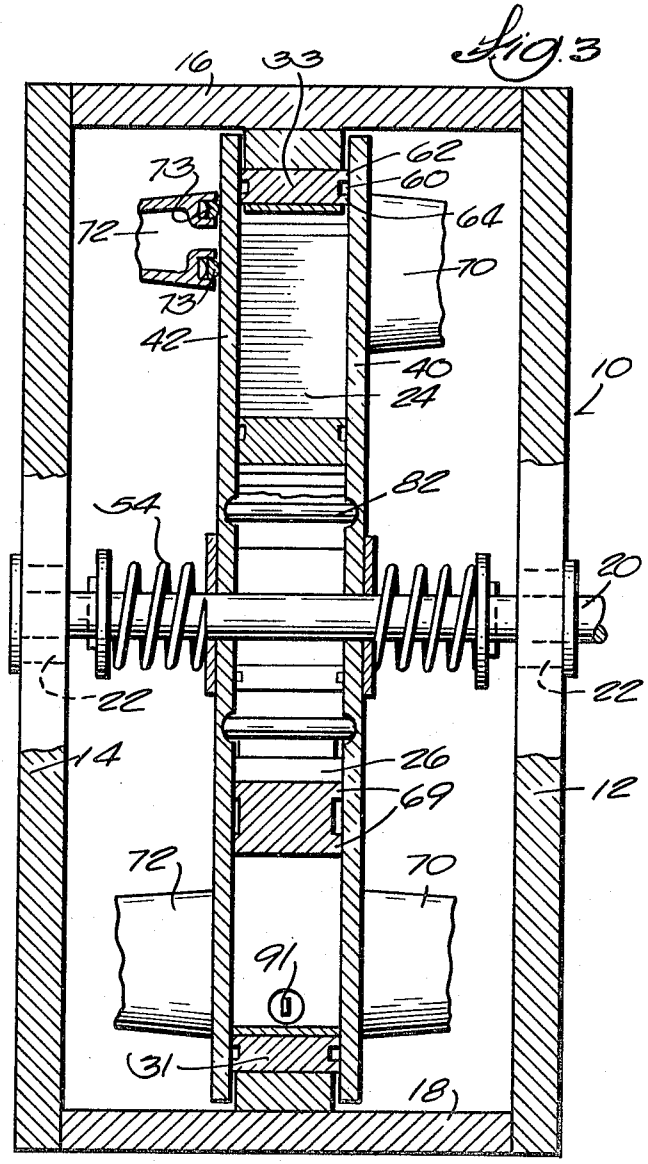
FIG. 3 is a view of the engine along line 3—3 of FIG. 2.

FIGS. 4–7 only disclose one intake port and one exhaust port which are located on opposite discs. Depending on the relative sizes and proportions, two spaced exhaust ports and two spaced intake ports may be required to accomplish the intake and exhaust sequences and insure that the full combustion mixture is introduced during movement of the ports past the working chambers. The manifolds are desirably provided with spring loaded seals 73 (FIG. 3).

Although the discs 40, 42 in the disclosed construction are spring-loaded, axially fixed discs could be employed. With this construction, spring-loaded piston side seals would be required. The pins are desirably spring-loaded toward the cam tracks and include one way locking devices. The cam tracks 80 are generally peanut-shaped or generally the configuration of a bi-lobed epitrochoid. The shape will vary somewhat depending on the pivot radius of the pistons and other proportions.

The apparatus of the invention can also be employed as a pumping device or compressor, with the exhaust ports serving as the discharge outlet for the compressed air or other fluid. When employed as a compressor, an air cleaner would be substituted for the carburetor 100.

What is claimed is:

1. An engine or pump having a frame to support a piston, output shaft, and intake and exhaust manifolds, an output shaft supported for rotation in said frame, a piston plate hingedly connected to said frame for swinging movement during the piston strokes, a working chamber associated with said piston plate, said working chamber comprising an arcuate wall having a radius concentric with the arc of movement of said piston plate, opposed parallel discs connected to said output shaft and located adjacent opposite edges of said piston plate and in planes at right angles with the pivotal axis of said piston, drive means on said piston cooperating with means on said discs to cause movement of said discs and said output shaft in response to movement of said piston plate, intake and exhaust manifolds, and ports in said discs which register with said manifolds during the intake and exhaust strokes to effect intake and discharge of working fluid.

2. An engine or pump in accordance with claim 1 including means for supporting and biasing said discs inwardly toward said pistons to provide a seal with the side edges of said piston plates.

3. An engine or pump in accordance with claim 1 wherein said drive means comprises cam tracks on the inside faces of said discs, and pins connected to said piston plates and extending laterally thereof and engaged in said cam tracks.

4. An engine or pump in accordance with claim 1 wherein said exhaust and intake manifolds have heads which carry spring-biased seals which bear against the outer surfaces of said discs to maintain seals therewith.

5. An engine or pump in accordance with claim 3 including two pivoted oppositely acting pistons and wherein said cam track is generally in the shape of a bi-lobed epitrochoid.

* * * * *